US006385880B1

(12) United States Patent
Naragon

(10) Patent No.: US 6,385,880 B1
(45) Date of Patent: May 14, 2002

(54) DECORATIVE LIQUID GLOBE

(76) Inventor: Josh R. Naragon, 4164 County Rd. 1, Bellefontaine, OH (US) 43311

( * ) Notice: Subject to any disclaimer, the term of this patent is extended or adjusted under 35 U.S.C. 154(b) by 0 days.

(21) Appl. No.: 09/512,015

(22) Filed: Feb. 24, 2000

Related U.S. Application Data

(60) Provisional application No. 60/124,334, filed on Mar. 15, 1999.

(51) Int. Cl.[7] ..... G09F 19/02
(52) U.S. Cl. ..... 40/406; 40/410
(58) Field of Search ..... 40/406, 409, 410; 446/267; 472/65

(56) References Cited

U.S. PATENT DOCUMENTS

| | | | | | |
|---|---|---|---|---|---|
| 4,490,931 | A | * | 1/1985 | Fleemin | 40/406 |
| 5,174,239 | A | * | 12/1992 | Sato | 40/406 X |
| 5,272,604 | A | * | 12/1993 | Lin | 40/409 X |
| 5,313,727 | A | * | 5/1994 | Murray, Jr. | 40/410 |
| 5,706,594 | A | * | 1/1998 | Lin | 40/406 |
| 5,816,884 | A | * | 10/1998 | Chang | 40/406 X |
| 5,864,976 | A | * | 2/1999 | Yang | 40/410 |
| 6,161,317 | A | * | 12/2000 | Wang | 40/406 |

* cited by examiner

*Primary Examiner*—Brian K. Green
(74) *Attorney, Agent, or Firm*—William Weigl

(57) ABSTRACT

A decorative liquid globe is provided with an electric motor and pump unit for recirculating liquid within the globe. The unit can be located entirely below the liquid chamber and have only an inlet tube or passage and an outlet tube or passage interconnecting the unit with the liquid chamber. Alternatively, providing that the unit can be properly housed in a self-contained combination motor and pump unit, it may be completely immersed in liquid and the pump inlet and outlet effect the recirculation. In this latter construction, electrical wires can pass through and be effectively permanently sealed with a wall of the chamber in a manner that avoids the potential of electrical shorting. In neither instance is there any requirement of moving parts such as shafts passing through a wall of the chamber, and the leakage potential of the prior art globes is eliminated. A movable decorative device within the globe may be made to respond to liquid recirculation without any mechanical interconnection with the motive power means. The liquid may be of two colors, one of which is heavier and of greater density than the first, whereby commencement of recirculation will initially pump the heavier liquid prior to pumping of the lighter liquid.

1 Claim, 1 Drawing Sheet

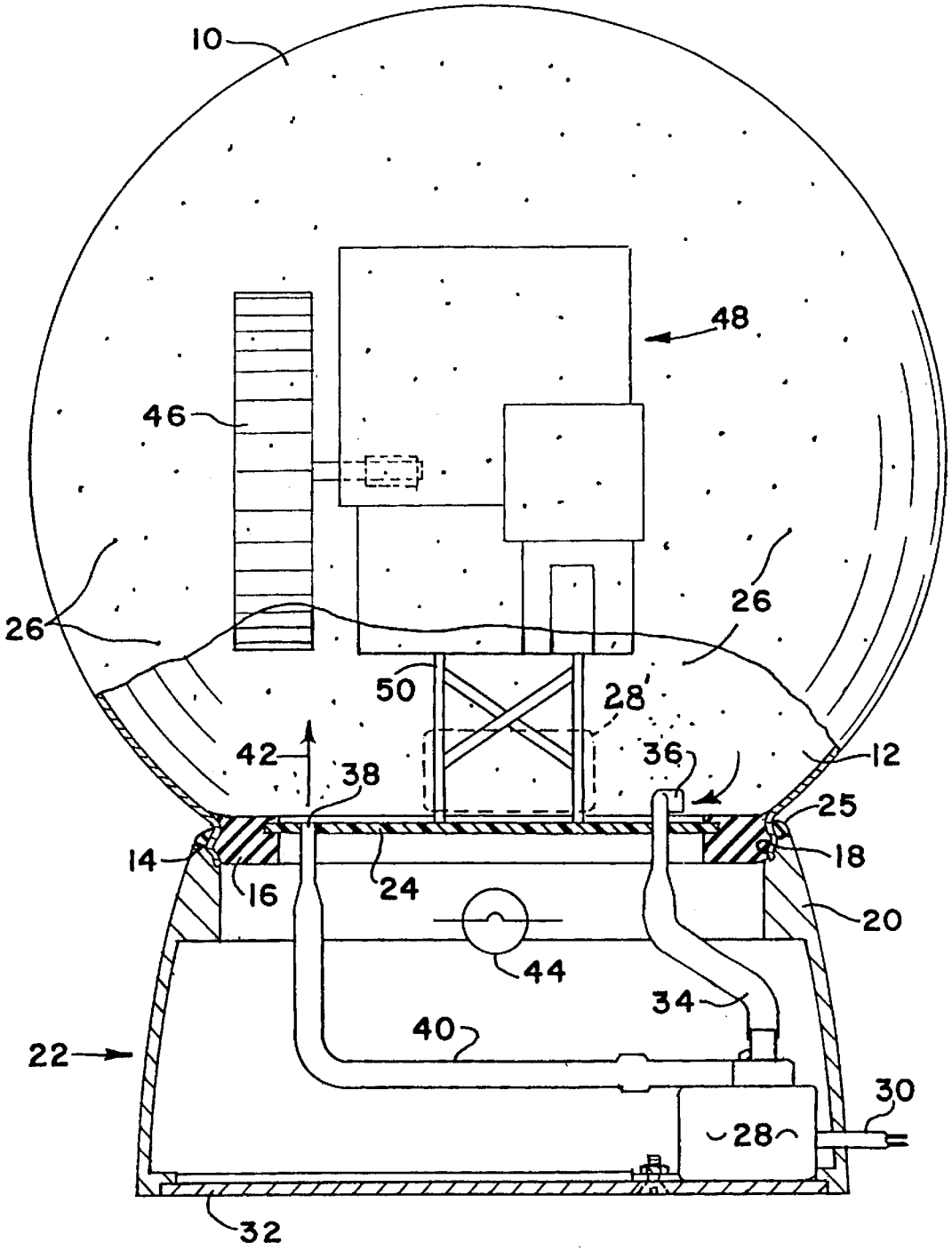
10
48
46
26
26
50
28
42
38
36
12
25
14
16
24
18
20
44
34
40
22
30
28
32

DECORATIVE LIQUID GLOBE

This application is based on U.S. Provisional Patent Application Ser. No. 60/124,334 filed Mar. 15, 1999.

This invention relates generally to decorative liquid globes, and in particular it relates to a liquid globe which is capable of continuous recirculation of the liquid either to operate a freely-movable device within the liquid, maintain circulation of "snow" or glitter, or both. The operation is achieved without movable mechanical parts passing between the interior and exterior of the globe, thereby eliminating a major potential for leakage that is present in prior art devices designed for similar purposes.

BACKGROUND OF THE INVENTION

All but a few articles that are commonly known as snow globes require that the globe be picked up and inverted to cause the settled snow globules or flakes to move to the then upside-down top of the globe. The globe is then again positioned upright so as to let the snow settle slowly, thereby presenting a pleasant wintry scene to the observer. Due to the fact that the settling takes place within a very short period of time, boredom soon sets in and the person discontinues the inverting action. The end result is that ordinarily, not long after purchase, the globe becomes a passive rather than an active scene or toy.

Several attempts have been made to cause the snow or glitter to move continuously through the liquid, one such attempt being shown in U. S. Pat. No. 5,313,727 issued to Joseph E. Murray, Jr. on May 24, 1994. In that patent, an electric motor mounted in a base below the liquid chamber has a shaft extending vertically upward from the motor through the bottom of the chamber to an articulated device within the liquid. In some instances, the articulated device is an impeller used to circulate the snow within the globe. In others, a toy such as a snowman can also be rotated in response to shaft rotation. In both cases, however, the motor shaft passes through the bottom wall of the globe and requires sealing against liquid leakage. For whatever reason, this U.S. patent was quickly forfeited to the public domain by non-payment of maintenance fees, and has now expired. It can only be assumed that the O-ring seal was inadequate to prevent leakage. Obviously, where the globe is placed on an expensive piece of furniture, liquid leakage is unacceptable. Additionally, if a leaking globe were placed in a tray for catching the leaking liquid to prevent furniture damage, an air bubble would soon appear in the globe, making it appear unnatural due to the liquid void at the top of the globe. Especially since the seal must necessarily be at the bottom of the liquid chamber because the transparent globe sets atop a base housing, it would appear impractical to utilize a globe that has a motor in the base and has a moving part or parts passing through a bottom wall of the chamber. A perfect shaft seal would be a natural solution to the problem, but for the product to have marketability, the seal would have to be completely effective for a very long period of time. Some globes are "limited edition" products which the purchasers expect to pass on to their heirs. Both water and chemicals are ordinarily used as the globe liquid, and certain of the chemicals are incompatible with gasket and washer materials commonly used for sealing purposes.

SUMMARY OF THE INVENTION

A decorative liquid globe is provided with an electric motor and pump unit for recirculating liquid within the globe. The unit can be located entirely below the liquid chamber and have only an inlet tube or passage and an outlet tube or passage interconnecting the unit with the liquid chamber. Alternatively, providing that the unit can be properly housed in a self-contained combination motor and pump unit, it may be completely immersed in liquid and the pump inlet and outlet effect the recirculation. In this latter construction, electrical wires can pass through and be effectively permanently sealed with a wall of the chamber in a manner that avoids the potential of electrical shorting. In neither instance is there any requirement of moving parts such as shafts passing through a wall of the chamber, and the leakage potential of the prior art globes is eliminated.

A principal object of the invention is to provide a decorative liquid globe with means for continuously circulating the liquid without requiring the need for moving parts or elements passing through a wall or walls of the liquid chamber.

Another object is to provide for recirculation of the liquid by a pressurized jet emanating from an outlet tube of a liquid pump.

An ancillary object is to utilize the jet to operate an animated object which is located solely within the chamber, the animation of which object assists in liquid circulation.

A further object is to provide particulate material such as snow or glitter in the liquid, and to utilize the jet and/or the animated object to maintain circulation on a continuing basis.

Still another object is to provide a transparent bottom wall for the globe and to provide an electric light below the bottom wall, whereby to illuminate the particles while they are suspended throughout the globe.

Other objects will become apparent from the following description, in which reference is made to the accompanying drawings.

BRIEF DESCRIPTION OF THE DRAWINGS

The sole FIGURE of the drawings shows the preferred location of the motor/pump unit in solid lines in a base housing below the globe, and also illustrates an alternative location of the unit in dotted lines, completely immersed in the liquid.

DESCRIPTION OF THE PREFERRED EMBODIMENTS

Referring now to the drawing, a glass globe 10 contains a liquid 12 which may be a mixture of water and propylene glycol, for example, either clear or color tinted. The globe is preferably semi-spherically shaped and is shown in the drawing as encompassing approximately 270 degrees of a full sphere. An annular bead 14 may be formed around the lower inner edge of the globe for enhancing sealing in relation to an internal annular gasket or washer 16 and to a corresponding seat 18 in an upper internal section 20 of a hollow base housing 22. The gasket 16 is grooved circumferentially at its inner periphery to receive a transparent bottom wall 24 of the globe 10. The gasket 16 thus seals both to an inner surface of the globe 10 and the outer edge of the bottom wall 24. Although the bottom wall 24 is a separate element from the glass globe, it is considered part of the total globe for reasons that will become apparent later. The globe is secured to the base housing 22 such as by a cement bead 25 so as to make the globe and housing integral.

In its preferred form, the liquid 12 contains an appropriate conventional quantity of particles 26 of imitation snow or glitter. The particles are made of a material which is suspendable in liquid during agitation of the liquid, but enables settling gradually toward the bottom wall 24 whenever agitation is discontinued. Since a primary objective of my invention is to continually (or intermittently under certain circumstances) agitate the liquid 12 to either keep the particles 26 suspended, operate an articulated device within the globe, or both, I provide a motive means such as a unitary combination electric motor and pump 28 connected to a 110V. electrical cord 30 and a wall outlet (not shown) of a house circuit. Examples of the motor/pump unit 28 that may be used are either the Mini-Jet or the Maxi-Jet models manufactured by Aquarium Systems, Inc. of Mentor, Ohio. These units find common use in connection with aquariums, terrariums, fountain reservoirs or other tabletop water devices. Each of the units is approximately two inches high, wide and deep. It is considered within the scope of my invention to substitute battery power for the house current although I know of no battery-powered pump which would be suitable for operation over a substantial period of time without requiring battery replacement.

The motor/pump 28 is secured by any known fastener means to a base plate 32 covering the underside of the base housing 22. The pump has a conventional tubular conduit 34 for passage of liquid from the inlet or entrance end 36 of the conduit 34 through the pump unit 28 and forcing it out as a jet stream from the outlet of exit end 38 of a tubular conduit 40. The entire globe, pump and conduits 34 and 40 are preferably devoid of air, their spaces being fully occupied by liquid. An exception that could practice the essence of my invention and be within its scope is where the top of the globe has a large air pocket and liquid is projected into the pocket as a fountain spray. The pump unit 28 conventionally includes electrically-driven movable parts for driving a liquid recirculating element (not shown) such as an impeller or a displacement pump and associated valving. The movable parts other than the liquid recirculating element are sealed from being contacted by liquids.

When a switch (not shown) in the cord 30 is closed, the motor of unit 28 operates the pump to develop displacement pressure to cause flow of liquid from the inlet end 36 through the conduits 34 and 40 and the pump to the outlet end 38. By virtue of the inlet end 36 being located adjacent the bottom wall 24 of the globe 10, settled or recirculating snow or glitter is drawn in by the pump and projected upwardly in the direction of the arrow 42 at the exit end 38. If desired, the bottom wall may be concave to form a depression that can serve as a sump for collection of particles 26. By placing the inlet end 36 adjacent the bottom of the sump depression, collection of the particles for recirculation can be maximized. Under certain circumstances, it may be desirable to provide for intermittent pumping rather than continuous operation, while still practicing my invention. For example, the liquid jet exiting from outlet end 38 can be made to vertically extend a flexible roll-up or extendible tube or sock carrying a special message. The message may say something like "Happy New Year", "Happy Anniversary" or "Happy Birthday". It can be activated by a clock controlling the timing of the pumping action and made to occur at a precise moment. A musical instrument in the base housing 22 can also be activated at the same moment to celebrate the event with an appropriate tune.

An electrical light bulb 44 is shown schematically immediately below the transparent bottom wall 24. The light bulb may have its own cord like cord 30 or be wired in parallel circuit to the motor/pump unit 28. Bulb 44 could be used as a night light in a child's bedroom, with or without pumping of the liquid and particles suspension.

An articulated decorative device 46 within the globe 10 can be driven by the liquid jet moving in the direction of arrow 42. In the example shown, the device 46 is a waterwheel journaled conventionally and freely in a house 48 mounted on stilts 50. Obviously, the liquid jet would be tangentially offset from the axis of the waterwheel so as to impinge at one side thereof and continually turn the device. Any kind of movable structure may be made to be operated by the jet. Its design should be such that the articulated device assists in proper distribution of particles to present a realistic view of snowfall, for example. Snowfall should descend from the top of the globe toward the bottom, while glitter distribution can be random. The device 46 may also be used without presence of snow or glitter. For example, it may be a carousel journaled on a vertical axis.

While I have illustrated but a single inlet and outlet jet, multiple jets may be utilized according to the distribution pattern desired. One or more motor/pump units may also be employed depending on the size and structure of the globe. In addition, while the globe is illustrated as being spherical, it may also be oblong or have another shape, as well.

An alternative form of my invention is also depicted in the drawing, where I show a motor/pump unit 28' resting just above the bottom wall 24. Such unit must be one which is capable of being completely immersible, with an electrical wiring connection (not illustrated) to the exterior of the globe 10. In both forms of the invention shown, no moving parts need pass between the interior and exterior of the globe. The unit 28' would have its inlet and outlet ends directly at the unit, or conduits can be selectively placed with the device 46 to obtain the most desirable circulation pattern.

Various other changes may be made without departing from the spirit and scope of the claims. For example, the scene in the globe can be one of a rocket lifting off from a launch pad. To give the appearance of the cloud created upon ignition, I may wish to use two separate kinds, weights and densities of liquid portions. The portions would be separable and distinct when the globe is in a quiescent state. The heavier portion of liquid would be white, and preferably settle in a cavity (not shown) adjacent the pump inlet, out of sight of a viewer. Then, when the pump is started, the white portion would be circulated first, giving the cloud appearance so commonly recognized during rocket lift-off. A number of other uses of multi-colored liquids will become apparent. In some instances, depending upon the nature of separation of the two liquids and size of the separated particles during recirculation, the glitter or snow may be dispensed with and the suspended particles may take their places.

Having described my invention, I claim:

1. In a decorative liquid globe having a transparent inverted thin-walled chamber and a bottom wall, a base housing having an upper outer edge supporting said chamber, a transparent liquid completely filling and sealed within said chamber at said edge, said liquid having a visually-discernable display material suspendible throughout said chamber upon circulation of said liquid and settlable at the bottom of said chamber upon said liquid reaching a quiescent state, a pump, a motor for operating said pump, an open conduit in communication with said pump, said pump being operated to circulate liquid and suspended material in said chamber through said conduit and pump between an open-ended liquid inlet passage and an open-ended liquid outlet passage of said pump, both of said passages being in constant communication with said liquid in said chamber, said motor being isolated and sealed with respect to liquid within the chamber, and a rotatable decorative device and a journal therefor mounted within the chamber, said decorative device being independent of mechanical interconnection with said motor and said decorative device further having a portion thereof in position to enable the device to be propelled by the flow of a liquid jet exiting from the open end of the outlet passage and thereby assist in distributing display material during operation of said motor.

* * * * *